United States Patent [19]

Jolley et al.

[11] 4,134,347

[45] Jan. 16, 1979

[54] METHOD AND APPARATUS FOR TUFTING EVEN LEVEL CUT PILE AND LOOP PILE IN THE SAME ROW OF STITCHING

[75] Inventors: Paul E. Jolley; Robert T. Crumbliss, both of Chattanooga, Tenn.

[73] Assignee: Spencer Wright Industries, Inc., Chattanooga, Tenn.

[21] Appl. No.: 873,939

[22] Filed: Jan. 31, 1978

[51] Int. Cl.[2] ..... D05C 15/36

[52] U.S. Cl. ..... 112/79 R; 112/79 A

[58] Field of Search ..... 112/79 R, 79 A, 78, 112/222, 223, 262, 410, 411; 66/121, 122, 116

[56] References Cited

U.S. PATENT DOCUMENTS

| | | | |
|---|---|---|---|
| 2,879,728 | 3/1959 | McCutchen | 112/79 R |
| 2,982,239 | 5/1961 | McCutchen | 112/79 R |
| 3,096,734 | 7/1963 | Card | 112/79 R |
| 3,138,126 | 6/1964 | Card | 112/79 R |
| 3,222,891 | 12/1965 | Wignall | 112/79 R X |
| 3,224,396 | 12/1965 | Wittler | 112/79 R |

*Primary Examiner*—H. Hampton Hunter
*Attorney, Agent, or Firm*—Alan Ruderman

[57] ABSTRACT

A tufting machine having loop seizing hooks facing opposite to the direction of fabric feed is disclosed having respective gate members pivotably mounted on the rear of the hooks. The gate member has a latch for selectively engaging the rear of the hook bill to lock entry of a loop into the closed end of the hook and onto the blade of the hook. Loops so precluded are shed by the hook bill as the hook rocks away from the loop seizing position and form uncut loop pile. Loops that are allowed to enter onto the blade portion are cut by a knife cooperating with the hook blade to form cut pile. The loop seizing edge of the bill is spaced from the loop engaging edge of the blade relative to the backing fabric. The gate members are disclosed as moved by pneumatic cylinders operable by electrically controlled air valves. The air valves selectively respond to timed signals received from a pattern control.

24 Claims, 7 Drawing Figures

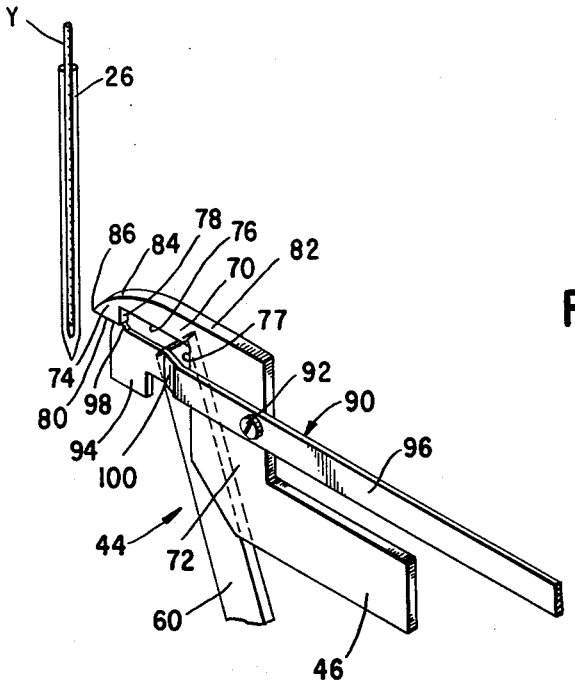
Fig. 2
Fig. 3
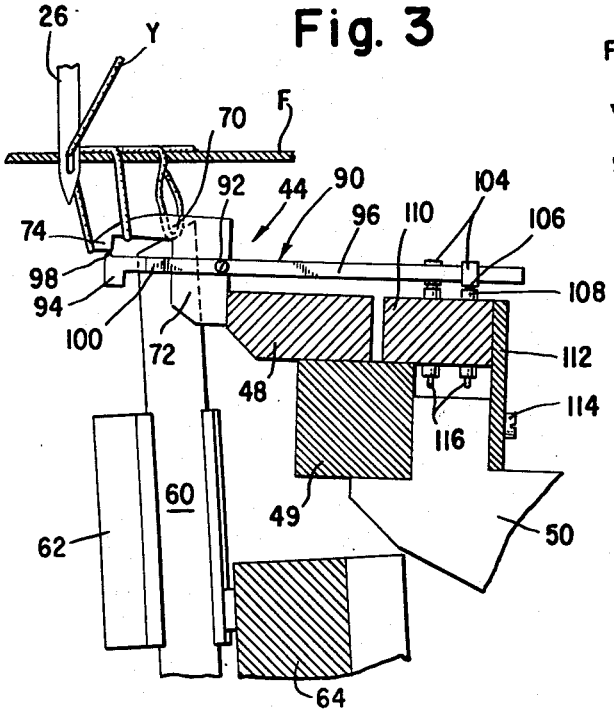
Fig. 4
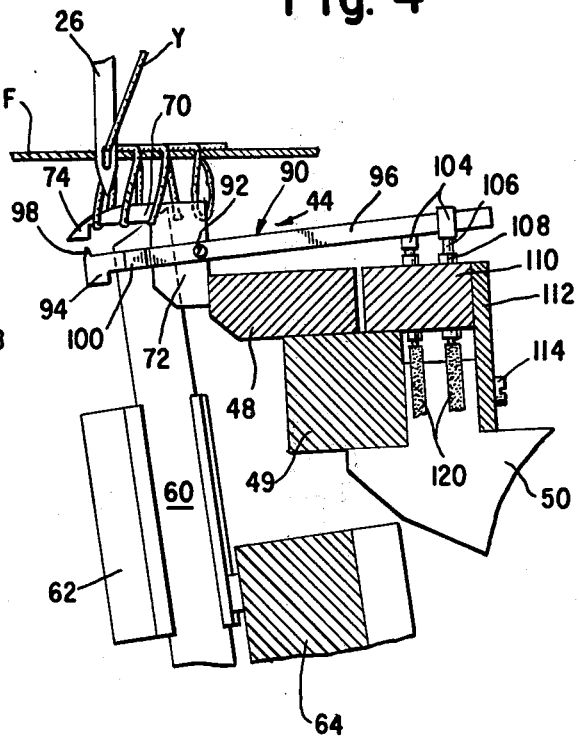

METHOD AND APPARATUS FOR TUFTING EVEN LEVEL CUT PILE AND LOOP PILE IN THE SAME ROW OF STITCHING

BACKGROUND OF THE INVENTION

This invention relates to tufting machines and more particularly to a method and apparatus for selectively forming cut pile and loop pile having substantially the same pile height as the cut pile in the same row of stitching in a backing fabric.

In U.S. patent of R. T. Card, U.S. Pat. No. 3,084,645, a method and apparatus for tufting cut pile and loop pile in the same row of stitching is disclosed. In spite of the enormous commercial success of that method and apparatus, and of the tufted product produced thereby, it has an inherent shortcoming that has limited it from even further success and acceptance of the tufted product produced. Because uncut loop pile is formed by backrobbing yarn from that loop to move a spring clip away from the point of the hook to allow the loop to be withdrawn from the hook while cut pile is not formed by backrobbing, it produces a tufted product having cut pile ends that project from the backing fabric more than the uncut loop pile. Thus, the pile height of the fabric produced is not level, but varies with the pattern. The cut pile has a greater pile height than one shorter uncut pile which appears less dense. This effect distracts from the appearance of the tufted product and has limited its appeal.

As pointed out in the aforesaid U.S. Pat. No. 3,084,645 there have been other, but commercially unsatisfactory, approaches for patterning a fabric selectively with cut pile and loop pile. In U.S. patent of McCutchen U.S. Pat. No. 2,879,728 selective loops on the hook are pushed off by a pattern controlled finger while others are allowed to stay on and are cut. Another proposal is illustrated in U.S. patent of McCutchen U.S. Pat. No. 2,879,729 wherein each needle has two opposed hooks associated therewith, one with a knife. When cut pile is desired a loop is transfered from the hook without the knife to the one with the knife. Although these proposals illustrate even level cut and loop pile their short-comings are readily apparent. Simplicity and reliability are primary concerns of the tufted fabric industry.

SUMMARY OF THE INVENTION

The present invention provides a simple and reliable mechanism and method for forming tufted fabrics having a pattered arrangement of cut pile and loop pile in any row of stitching by preventing selective loops from entering the hook beyond the bill. No extra backrobbing of yarn beyond that conventionally done to tighten the stitches into the backing is required to form the uncut loop pile. Thus, the uncut loop pile and the cut pile ends are substantially the same length, i.e. the pile height of the pattern is substantially level. Since there is no extra backrobbing, i.e. no difference in the amount of yarn fed whether loop pile or cut pile is being formed conventional yarn feed rolls may be used rather than a yarn feed pattern attachment.

In practicing the principles of the present invention a gate member is mounted so as to selectively engage a rear portion of the bill of the hook to close the bill from the remainder of the hook. A cut pile hook having the bill pointing opposite to the direction of fabric feed is employed together with a tufting knife blade. When the bill is open the movement of the fabric results in a loop that has been seized by the bill to move onto the blade of the hook toward the closed end where it will be cut as in conventional cut pile machines. However, when the bill is closed by the gate, a seized loop is prevented from moving onto the blade and is released from the bill as the hook rocks away from the loop seizing position. A conventional pattern control may be employed for controlling the operation of the gate mechanism.

In the preferred form of the invention the gate is pivotably mounted on the hook so as to move with the hook as the hook conventionally moves toward and away from the loop seizing position. The gate can also be moved about its pivot journal selectively to open the bill to the blade of the hook or to close the rear of the bill from the blade of the hook. Means are provided for timely actuating the gate upon receipt of signals from the pattern control. The hook itself is constructed with the loop seizing edge of the bill in a plane spaced from the loop engaging edge of the blade so as each stitch is tightened the loop is drawn to a level above the loop seizing edge of the bill. This prevents spearing of the previous loop, if uncut, when the bill seizes the next loop, and provides for even level of both the cut pile and the uncut loop pile.

Consequently, it is a primary object of the present invention to provide a simple and reliable method and apparatus for forming tufted fabrics having a patterned arrangement of cut pile and loop pile which can be of substantially the same pile height.

It is another object of this invention to provide in a tufting machine a hook adapted to point in the direction opposite the fabric feed and a gate member associated with and mounted for oscillatory movement with the hook and which can selectively close the bill of the hook from the blade of the hook to prevent seized loops from moving onto the blade, and can thereby shed the loop as the hook moves away from the loop seizing position.

It is a further object of the present invention to provide in a tufting machine a gate member for a cut pile hook that is positioned in accordance with a pattern control for selectively precluding loops seized by the bill of the hook from moving onto the blade of the hook while allowing other loops to pass onto the blade to be cut.

It is a still further object of the present invention to provide a hook for a tufting machine having a gate member pivotably supported thereon and selectively pivoted for closing the rear of the hook bill from the blade of the hook and for opening the bill to the blade.

It is yet a further object of the present invention to provide a hook having a gate member associated therewith in which the hook has a loop seizing edge on the bill that is in a plane spaced from the loop engaging edge of the blade of the hook.

BRIEF DESCRIPTION OF THE DRAWINGS

The particular features and advantages of the invention as well as other objects will become apparent from the following description taken in connection with the accompanying drawings, in which:

FIG. 2 is a perspective view of the preferred form of the hook and illustrating the position of the needle preparatory to forming a loop;

FIG. 3 is a fragmentary vertical sectional view of a portion of the tufting machine illustrated in FIG. 1, but enlarged to show the hook with the gate closed and a loop being shed to form an uncut loop;

FIG. 4 is a view similar to FIG. 3, but showing the hook with the gate open to allow a loop to move from the bill to the blade of the hook and illustrating the severing of a loop on the blade to form a cut pile;

DESCRIPTION OF THE PREFERRED EMBODIMENT

Figure 1:
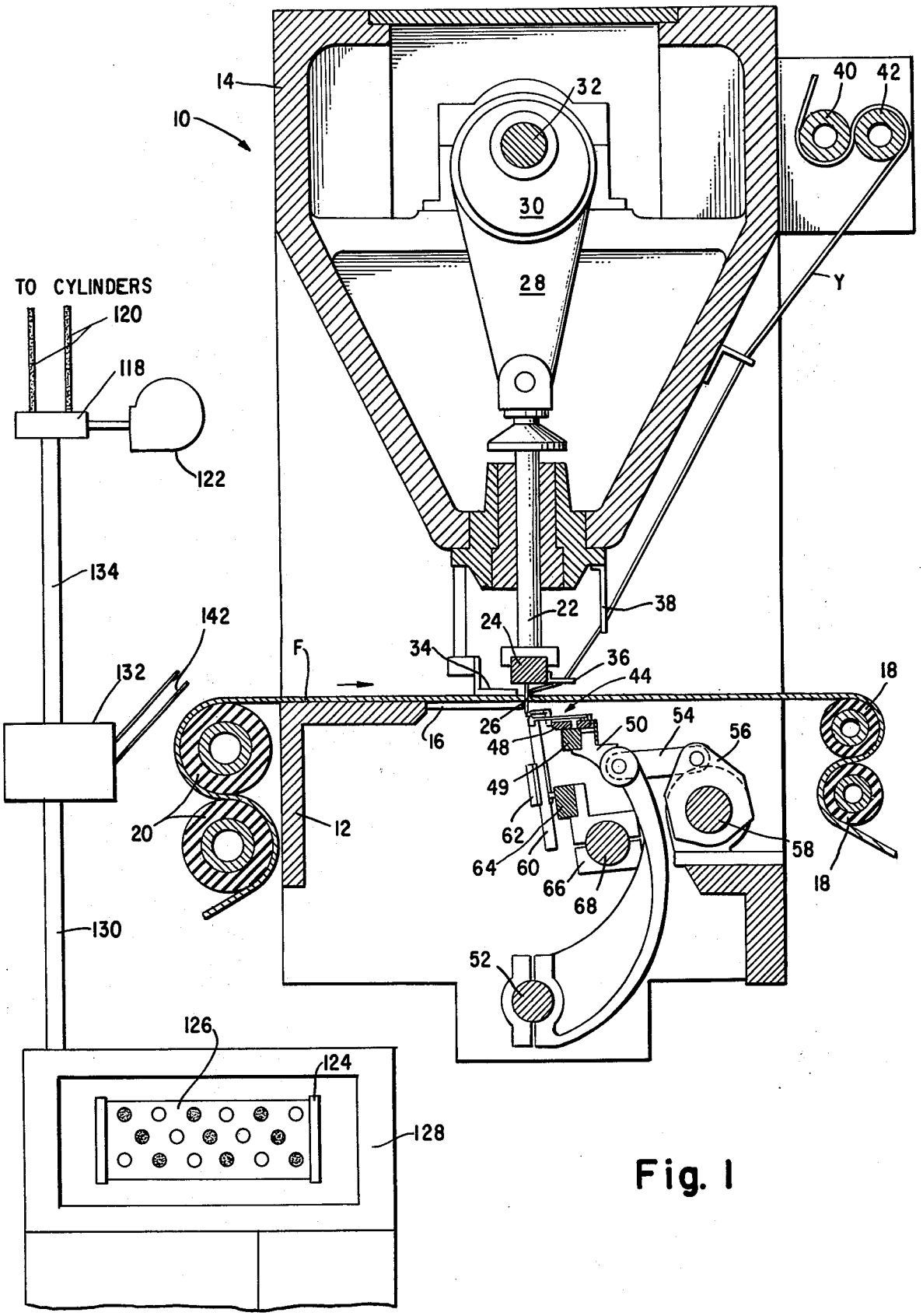
FIG. 1 is a vertical sectional view taken transversely through a multiple needle tufting machine embodying apparatus constructed in accordance with the principles of the present invention and illustrating certain aspects in diagramatic form.

Referring now to the drawings, there is illustrated in FIG. 1 a tufting machine 10 having a frame comprising a bed 12 and a head 14 disposed above the bed. The bed 12 includes a bed plate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F through fingers on the bed plate 16 upon reciprocation of the needle bar 24 to project loops of yarn Y therethrough. Endwise reciprocation is imparted to the push rods 22 and thus the needle bar 24 and needles 26 by a link 28 which is pivotally connected at its lower end to the push rods 22 and at its upper end to an eccentric 30 on a driven rotary main shaft 32 that is journalled longitudinally in the head 14. A presser foot assembly 34 may be supported on the head 14 to hold down the fabric F during needle retraction. A yarn-jerker 36 is carried by the needle bar 24 and operates to engage the yarn between a stationary yarn guide 38 on the frame of the machine and the needles 26.

Yarn Y is supplied to each needle 26 by any convenient type of yarn feed mechanism which, unlike that required in the aforesaid U.S. Pat. No. 3,084,645, need not be controlled to feed selectively. Thus, conventional yarn feed rolls 40 and 42 adapted to be continuously rotated by any convenient means, preferably synchronized with the main shaft 32, to continuously feed fixed lengths of yarn to the needles may be mounted on the head 14. For reasons which will become apparent the amount of yarn fed to the needles is less than that demanded by the system so that yarn is backdrawn from each loop after it has been formed as each stitch is tightened into the fabric F.

Mounted within the bed for cooperation with the needles to seize loops of yarn presented thereby are a plurality of hooks generally illustrated at 44 which point in the direction opposite to that to which the fabric is fed and to which further reference will be made. The hooks have mounting portions 46 that are mounted in hook bars 48 carried by a mounting bar 49 secured to the upper end of a rocker arm 50. Any conventional means to oscillate the arm 50 may be provided. In the preferred embodiment the lower end of the rocker arm 50 is clamped to a laterally extending rock shaft 52 journalled in the bed. Pivotably connected to the upper portion of the rocker arm 50 is one end of a connecting link 54 having its other end pivotably connected between forked arms of a jack shaft rocker arm 56. The arm 56 is clamped to a jack shaft 58 which has oscillating motion imparted thereto by conventional drive means such as a cam and lever means (not shown) from the main shaft 32 in timed relationship with the reciprocation of the needles. The tufting machine incorporates a plurality of knives 60 which may cooperate with the hooks to cut selected loops to form cut pile as hereinafter described. The knives may be mounted in knife blocks 62 secured to a knife bar 64 which in turn is secured to a knife shaft rocker arm 66 clamped to a knife shaft 68. Oscillatory movement is imparted to the knife shaft 68 to conventionally drive the knives into engagement with one side of the respective hooks as known in the art to provide a sissors-like cutting action.

Figure 5:
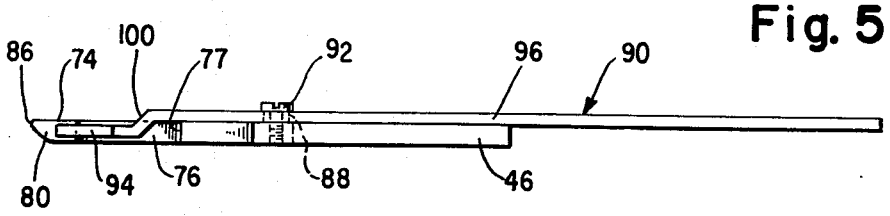
FIG. 5 is a bottom plan view of the hook and gate.
Figure 6:
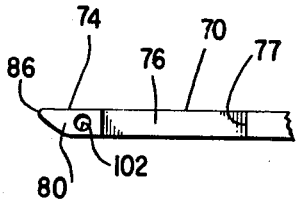
FIG. 6 is a bottom plan view of the bill and a portion of the blade of the hook illustrating the gate latch receiving hole.

In accordance with the invention the hooks 44, as best illustrated in FIGS. 2, 5 and 6, are planar members having a body portion including a blade 70 and a shank 72 which includes the mounting portion 46, and a bill 74 at the free end extending from the blade. The blade 70 extends from the shank 72 and has a bottom edge 76 extending from a throat 77, formed between the blade and the shank, and an edge 78, joining the bottom edge 76 of the blade with a bottom edge 80 of the bill. In the preferred form of the hook the blade has a top edge 82 that smoothly merges with the top edge 84 of the bill, and the top edge of the bill slopes to meet the bottom edge 80 to form a point 86. For reasons which will be explained, the bottom edge 80 of the bill is spaced below the bottom edge 76 of the blade. Cutting of a loop on the blade by the knife 60 ideally occurs at the edge 76 adjacent to the throat 77. In the preferred form of the hook the edge 76 is substantially normal to the edge 78 and to the axis of the shank 72.

A bushing 88 is mounted in a hole (not shown) in a gate member 90 and together they are pivotably journalled on a screw 92 that is threaded into the shank 72 at the side of the hook opposite to that against which the knife 60 acts. The gate 90 includes a head portion 94 at one extremity facing in the same direction as the hook bill and a tail portion 96 at the other side of the pivot screw 92. The gate thus acts as a pivotable lever. The head includes a substantially pointed protuberance 98 defining a latch in the upper free end which is adapted to engage the bottom edge 80 of the bill 74 adjacent to the joining edge 78 to prevent selected loops from passing from the bill onto the blade. The gate is thus bent at 100 from the plane of the face or surface of the hook at the shank to substantially intermediate the faces at the bill. To ensure a positive lock between the gate and the bill a small hole 102 preferably is formed in the bill at the length engaging position between the planar faces for receiving the latch. Thus, when the gate is closed no loop will slip by the latch.

To pivotably move the gate about its pivot journal the tail portion 96 of the gate may be selectively actuated by any convenient means controlled by a pattern. In the preferred embodiment each tail 96 is received between a forked member 104 which entraps the tails for swinging movement. The forked members 104 are secured to stems 106 of pistons (not illustrated) of respective pneumatic cylinders 108 mounted in pneumatic cylinder supporting bars 110 that are mounted for oscillation with the hooks 44. To this end the supporting bars 110 may be secured to a bracket 112 that is attached by bolts 114 or the like to the rocker arm 50 and the supporting bars 110 may rest on or be secured to the upper surface of the mounting bar 49 adjacent to the hook bar 48. As illustrated the pistons of the cylinders 108 are normally biased downwardly so that normally the gates are positioned with the latch closing the rear of the bills for forming loop pile, but the reverse situation with upwardly biased pistons may be constructed readily. Thus, as illustrated, to form cut pile air is admitted to inlet nipples 116 to drive the pistons and forked members 104 upwardly to pivotably open the gates. The admission and release of air from each of the cylinders 108 is effected by respective electrically controlled pneumatic valves 118 having air lines 120 communicating with the valves and with a compressor 112 or other source of air under pressure. The pneumatic system is preferred because of their large stroke for their size but other means such as electrical solenoids may be used in place of the cylinders, valves and compressor. The valves are, however, electrically controlled to allow pressurized air from the compressor to enter the cylinders or to vent the air from the cylinders to atmosphere, thereby pivoting the gate.

To control the valves 118 and thereby the pile type produced by a given needle loop any convenient patterning device may be used, such as a magnetic type system, a punching tape system or a microprocessor with programmed memory. However, as is conventional in the tufting industry it is preferred to use a transparent pattern drum 124 carrying a pattern sheet 126 having a pattern painted with opaque material on a transparent sheet mounted in a console 128. Since this pattern reading and signaling mechanism is well known in the art reference may be had to Ingham et al U.S. Pat. No. 3,922,979 or Erwin et al U.S. Pat. No. 3,272,163 for a more complete description thereof. Suffice it to say that photocells within the console sense the light and dark areas of the pattern through the drum by mounting a source of light on one side of the drum and the photocelles on the other side. The output of the photocells are transmitted to switching units within the console 128, the outputs of which are transmitted by wires within a conduit 130 to an amplifier 132 where these signals are amplified and transmitted by wires within conduits 134 to the individual pneumatic valves 118.

Figure 7:
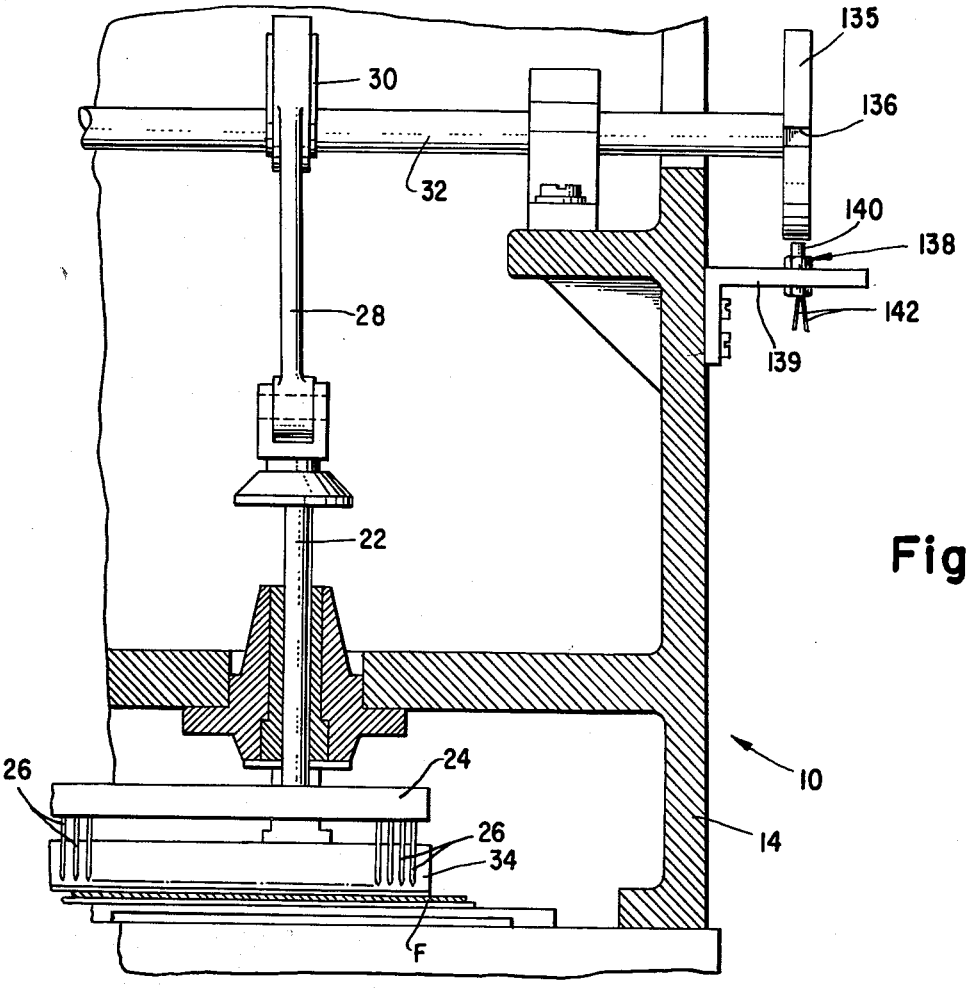
FIG. 7 is a fragmentary front elevational view partly in section of the tufting machine illustrating a method of synchronizing the actuation of the gates to the rocking movement of the hooks.

In order to ensure that the signals from the pattern console 128 are timely presented to the valves 118 so that the pneumatic cylinders actuate the gates when a loop is either off the bill 74 for uncut pile or behind the edge 78 and onto the blade for loops to be cut, synchronizing means timed to the oscillation of the hooks may be provided. This can be any convenient means, but a simple one that is preferred is a clocking circuit providing a pulse timed to the exact position of the tufting machine main shaft 32 to enable and disable the signals received by the amplifier 132 from the pattern console 128. To this end, as illustrated in FIG. 7, a metallic timing disk 135 may be fixed on the main shaft 32 adjacent to one end and includes a slotted truncated radial opening 136 of a small peripheral arc. A proximity probe 138 may be threadedly mounted on a bracket 139 on the head 14 and includes a sensing head 140 extending toward and just spaced from the circumference of the disk 136. The probe, which is basically a metal detector, includes conducting leads 142 which are connected to the amplifier 132 into circuitry which may include proximity switching means (not illustrated) in the circuit with the amplified outputs of the photocells. Synchronizing systems of this type and the circuitry therefor are well known and further description thereof is not deemed necessary to the present invention. Whenever the solid circumference of the disk is adjacent to the probe head 140 the primary output of the sensor goes high and when the slot passes the head 140 the primary output is switched low. A pulse timed to the rotation of the main shaft 32 and therefore the oscillation of the hooks 44 is provided to energize the amplifier circuits for tranmitting timed photocell signals to the valves 118.

In operation, the bill of the hook 44 enters and seizes a loop presented by the needle at its loop seizing edge 80. Since the bill faces oppositely to the direction of fabric feed the loop is moved by the fabric toward the closed end of the hook as the hook oscillates away from the loop seizing position. Now if the pattern on the sheet 126 has called for this stitch to be an uncut loop, a signal to this effect was timely given after the previous stitch to move the valve 118 to vent air from the cylinder 108. Thus, since the pistons are normally biased downwardly the gates are pivoted so that the latch 98 engages into the hole 102 in the rear of the bill to lock the path of the loop against further movement toward the closed end. As illustrated in FIG. 3 this loop thus prevented from moving onto the blade is shed by the bill as the hook oscillates away from the loop seizing position. As previously stated the amount of yarn fed the system is set less than that required so that as the needle bar reciprocates upwardly the yarn jerker 36 backdraws the loop. This together with possible further backdrawing by the needle on the next down stroke draws the loop to the level of the edge 76 of the blade so that an uncut loop at that level is formed. Thus, this loop is not speared when the bill seizes the next loop since it is above the edge 80 of the bill.

If the pattern next calls for a cut pile the signal is clocked to the valves 118 which admits pressurized air to the cylinder after the previous loop has been shed and the gate is pivoted to move the latch 98 away from the bill 74. Thus, as illustrated in FIG. 4, the loop now seized by the bill is permitted to move from the bill to the blade as the fabric moves the loop toward the shank end of the hook. Now as the loop is backdrawn, it is drawn up against the edge 76 of the blade and gradually moves rearwardly to the knife cutting location where it is severed by the knife 60 to form cut pile at the same level as the uncut loops.

The pattern will determine the number of successive loops that will be cut or uncut. To prevent the gate from pivotably oscillating unnecessarily the gate should stay open on successive cut pile stitches and closed on successive uncut loops and should only be actuated when a positive switching signal is given to the valves. It should be understood that though the disclosure only related to one hook, a tufting machine has a multiplicity of hooks and that by incorporating the gating feature of the present invention in many, if not all, of the hooks, unique patterning effects may be produced in the base fabric.

Numerous alterations of the structure herein disclosed will suggest themselves to those skilled in the art. However, it is to be understood that the present invention disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a tufting machine, means for feeding a base fabric in one direction, a yarn-carrying needle disposed on one side of said base fabric, means for reciprocating the needle for penetrating the base fabric and forming loops therein, means for feeding yarn to said needle, a hook disposed on the opposite side of the base fabric from said needle, said hook comprising a body portion including a blade, and a loop seizing bill extending from said blade facing in a direction opposite to the direction of fabric feed, means for mounting said body portion for oscillatory movement toward and away from said needle so that said blade enters and seizes successive loops, the feeding of the fabric moving the loops upon the bill toward the body portion, a knife cooperating with said blade for severing loops thereon, gate means for engagably cooperating with said bill for closing the bill from the blade to prevent loops from moving onto the blade and for disengaging said bill for opening the bill to the blade to permit loops to move onto the blade, whereby loops permitted entry onto the blade are severed by said knife and loops prevented from entry onto the blade are shed by the bill as the hook moves away from the needle, and control means for selectively moving said gate means into and out of engagable cooperation with said bill.

2. In a tufting machine as recited in claim 1 wherein said gate means comprises a lever, journal means for pivotably mounting said lever intermediate its extremities on said body portion, said lever having a latch on one side of said journal means for engaging said bill, said control means including means acting on the lever on the other side of said journal means.

3. In a tufting machine as recited in claim 1 wherein said bill has a loop seizing edge, said loop seizing edge being that part of the bill disposed furthest from the base fabric, said blade having a loop engaging edge, said loop engaging edge being that part of the blade disposed furthest from the base fabric and against which loops permitted entry onto said blade are severed, said loop seizing edge being disposed further from said base fabric than said loop engaging edge.

4. In a tufting machine as recited in claim 3 wherein said means for feeding yarn to said needle feed a predetermined length of yarn as required to form a loop disposed at said opposite side of the base fabric at the level of the loop engaging edge of said blade, whereby each loop will be backdrawn from the level of said loop seizing edge to the level of said loop engaging edge.

5. In a tufting machine as recited in claim 2 wherein said hook has a finite thickness between two faces, said lever being pivotably mounted on one face of said hook and said latch engages said bill intermediate said faces.

6. In a tufting machine as recited in claim 4 wherein said gate means comprises a lever, journal means for pivotably mounting said lever intermediate its extremities on said body portion, said lever having a latch on one side of said journal means for engaging said bill, said control means including means acting on the lever on the other side of said journal means, said hook having a finite thickness between two faces, said lever being pivotably mounted on one face of said hook and said latch engages said bill intermediate said faces.

7. In a tufting machine, means for supporting a base fabric, means for stitching a yarn continuously through said base fabric to form loops therein, a hook having a free end for entering the loops in succession, and a closed end, said hook having a bill at the free end and a blade adjacent said bill and said closed end, means for relatively moving said loops upon said bill toward said blade, means cooperating with said blade for severing selected loops thereon, gate means for engagably cooperating with the bill for closing the passage of a loop from the bill to the blade and for disengaging from said bill for opening the passage of a loop from the bill to the blade, and control means for selectively moving said gate means into and out of engagable cooperation with said bill, whereby loops passing from the bill to the blade are severed and loops prevented from passing from the bill to the blade are shed from the bill to form uncut loops.

8. In a tufting machine as recited in claim 7 in which means are provided for feeding said fabric in the direction of the closed end of said hook.

9. In a tufting machine as recited in claim 7 wherein said gate means comprises a lever having a latch portion, and means for pivotably mounting said lever on said hook for movement of said latch portion toward and away from said bill.

10. In a tufting machine as recited in claim 9 wherein said hook has a finite thickness between two faces, said lever being pivotably mounted on one face of said hook and said latch portion engages said bill intermediate said faces.

11. In a tufting machine as recited in claim 7 wherein said bill has a loop seizing edge, said loop seizing edge being that part of the bill disposed furthest from the base fabric, said blade having a loop engaging edge, said loop engaging edge being that part of the blade disposed furthest from the base fabric and against which loops permitted entry onto said blade are severed, said loop seizing edge being disposed further from said base fabric than said loop engaging edge.

12. In a tufting machine as recited in claim 11 wherein a predetermined length of yarn is supplied to said stitching means to form each loop, said length of yarn being such as to form a loop disposed at the level of the loop engaging edge of said blade, whereby each loop will be backdrawn from the level of said loop seizing edge to the level of said loop engaging edge.

13. In a tufting machine as recited in claim 11 wherein said severing means comprises a knife, and means for oscillating said knife to cooperate with said loop engaging edge of said blade.

14. In a tufting machine, means for feeding a base fabric in one direction, a yarn-carrying needle disposed on one side of the base fabric, means for reciprocating said needle for penetrating said fabric and forming loops therein, a hook disposed on the other side of the base fabric from the needle and having a free end facing in a direction opposite to the direction of feed of the fabric for seizing the loops in succession, and a closed end, said hook having a bill including a loop seizing edge at the free end, a blade intermediate said bill and said closed end and including a loop engaging edge closer to said fabric than said loop seizing edge, means for oscillating said hook toward and away from said needle, a knife for cooperating with the blade of said hook to sever loops on said loop engaging edge, means for oscillating said knife, a gate movable relative to said hook and having a free end for selectively engaging and disengaging said bill adjacent said blade to respectively close and open passage of a loop from the bill to the blade, control means for moving said gate into and out of engagement with the bill so that certain loops move onto the blade and other loops are shed by the bill, and means for feeding to said needle upon each penetration a length of yarn inadequate to accommodate the yarn requirements of the system, whereby all the loops will be backdrawn from the loop seizing edge to the level of the loop engaging edge.

15. In a tufting machine as recited in claim 14 wherein said gate is pivotably mounted on said hook.

16. In a tufting machine as recited in claim 15 wherein said hook has a finite thickness between two faces thereof, said gate being pivotably mounted on one of said faces, and said free end of said gate being engagable with the bill intermediate said faces.

17. A method of tufting cut pile and loop pile in the same row of stitching comprising supporting and feeding a base fabric in one direction, stitching a yarn continuously through said base fabric as the fabric moves to form a row of successive yarn loops on one side of said fabric, supporting upon said one side of said fabric on oscillating hook having a free end pointing in the direction opposite the fabric feed so that the free end enters the loops in succession and having a blade portion adjacent the free end that does not enter the loops, severing a selected loop upon the blade portion to produce cut pile, closing the free end adjacent the blade portion with a movable gate to prevent entry of another selected loop onto said blade portion, and sheding said other selected loop from the free end to produce an uncut loop.

18. A method of tufting cut pile and loop pile in the same row of stitching comprising supporting and feeding a base fabric in one direction, stitching a yarn continuously through said base fabric as the fabric moves to form a row of successive yarn loops on one side of said fabric, supporting upon said one side of said fabric on oscillating hook having a free end pointing in the direction opposite the fabric feed so that the free end enters the loops in succession and having a blade portion adjacent the free end that does not enter the loops, closing the free end adjacent the blade portion with a movable gate to prevent entry of a selected loop onto said blade portion, sheding said selected loop from the free end to produce an uncut loop, moving the gate away from the free end to permit entry of another selected loop onto said blade portion, and severing said other selected loop upon the blade portion to produce cut pile.

19. A method of tufting cut pile and loop pile in the same row of stitching comprising supporting and feeding a base fabric in one direction, actuating a needle to stitch a yarn continuously through said base fabric as said fabric moves to form a row of successive yarn loops on one side of said fabric, supporting upon said one side of said fabric an oscillating hook having a free end pointing in the direction opposite to the direction of fabric feed so that the free end enters the loops in succession and having a blade portion adjacent the free end that does not enter the loops and is disposed closer to said base fabric than said free end, feeding to said needle upon each stitch a predetermined length of yarn that is inadequate to accommodate the yarn requirements of the system, closing the free end adjacent the blade portion with a movable gate to prevent entry of a selected loop onto said blade portion, sheding said selected loop from the free end to produce an uncut loop, moving the gate away from the free end to permit entry of another selected loop onto said blade portion, backdrawing yarn from each loop intermediate the formation of each loop and the next successive loop to reduce the size of each loop to substantially the level of the blade portion, and severing said other selected loop upon said blade portion to produce cut pile.

20. A hook for use in a tufting machine, said hook being planar and comprising a body portion having a blade and a shank having a mounting portion for mounting in a tufting machine hook bar, said blade extending from said shank to define a throat therebetween, said hook further comprising a bill extending from said blade remote from said shank, said blade having a top edge and a bottom edge that extends from said throat to said bill, said bill having a top edge that slopes toward said top edge of said blade and a bottom edge spaced below said bottom edge of said blade to define a joining edge connecting the bottom edge of said bill and the bottom edge of said blade, a gate member having a free end defining a latch, and means for pivotably mounting said gate on said shank for swinging said latch into and out of engagement with said bottom edge of said bill adjacent said joining edge.

21. In a hook as recited in claim 20 wherein said bottom edge of said bill includes means defining a hole adjacent said joining edge, said latch having a protuberance for entering said hole when said latch swings into engagement with said bottom edge of said bill.

22. In a hook as recited in claim 20 wherein said bottom edge of said blade adjacent to said throat is formed to cooperate with a knife to sever loops of yarn against said lower edge of said bill.

23. In a hook as recited in claim 20 wherein said bottom edge of said blade extends from said throat substantially normal to the axis of said shank adjacent said throat, and said joining edge is substantially normal to said bottom edge of said blade.

24. In a hook as recited in claim 20 wherein said gate is pivotably mounted on a planar face of said shank, and said latch engages said bottom edge of said bill substantially intermediate its planar faces.

* * * * *